US006991688B2

(12) United States Patent
Petitjean et al.

(10) Patent No.: US 6,991,688 B2
(45) Date of Patent: Jan. 31, 2006

(54) METHOD FOR OXALATING THE GALVANIZED SURFACE OF SHEET METAL

(75) Inventors: Jacques Petitjean, Manom (FR); Geneviève Klam, Stuckange (FR)

(73) Assignee: Usinor, Puteaux (FR)

( * ) Notice: Subject to any disclaimer, the term of this patent is extended or adjusted under 35 U.S.C. 154(b) by 52 days.

(21) Appl. No.: 10/169,486

(22) PCT Filed: Jan. 9, 2001

(86) PCT No.: PCT/FR01/00049

§ 371 (c)(1),
(2), (4) Date: Sep. 19, 2002

(87) PCT Pub. No.: WO01/51682

PCT Pub. Date: Jul. 19, 2001

(65) Prior Publication Data

US 2003/0070731 A1 Apr. 17, 2003

(30) Foreign Application Priority Data

Jan. 13, 2000 (FR) ..... 00 00370

(51) Int. Cl.
*C23C 22/48* (2006.01)

(52) U.S. Cl. ..... 148/273; 148/243; 148/272; 428/457; 428/469

(58) Field of Classification Search ..... 148/243, 148/272, 273; 428/457, 469
See application file for complete search history.

(56) References Cited

U.S. PATENT DOCUMENTS

| | | | | |
|---|---|---|---|---|
| 1,954,744 | A | 4/1934 | Petreson | |
| 2,060,365 | A | 11/1936 | Curtin | |
| 2,081,449 | A | 5/1937 | Cook | |
| 2,086,712 | A * | 7/1937 | Green | 428/470 |
| 2,809,138 | A | 10/1957 | Wagner | |
| 5,795,661 | A | 8/1998 | Taffinger | |

FOREIGN PATENT DOCUMENTS

| | | |
|---|---|---|
| FR | 1 066 186 | 6/1954 |
| GB | 394 211 | 6/1933 |

OTHER PUBLICATIONS

General Chemistry, Luder et al., 1965, pge 282.*
Handbook of Chemistry and Physics, 54 Edition, 1964, p. F-78.*
Patent Abstracts of Japan, vol. 014, No. 146, Mar. 20, 1990.
Derwent Publication AN 2000-239715.

* cited by examiner

*Primary Examiner*—John P. Sheehan
(74) *Attorney, Agent, or Firm*—Sughrue Mion, PLLC

(57) ABSTRACT

A method for forming a zinc oxalate coating on the surface of a strip or sheet of metal covered with a zinc or zinc alloy coating other than zinc/iron coatings, with the aid of an aqueous solution consisting of oxalic acid having a concentration of between $5.10^{-3}$ and 0.1 mole/l, and at least one compound and/or ion of an oxidant zinc metal having a concentration of between $10^{-6}$ and $10^{-2}$ mole/l, and possibly a wetting agent. The inventive method enables sheet metal to be treated at very high speeds without using large amounts of oxidant. It facilitates management of treatment baths. The invention can be used in the lubrication of sheet metal, especially for die stamping.

14 Claims, 5 Drawing Sheets

Figure 1:
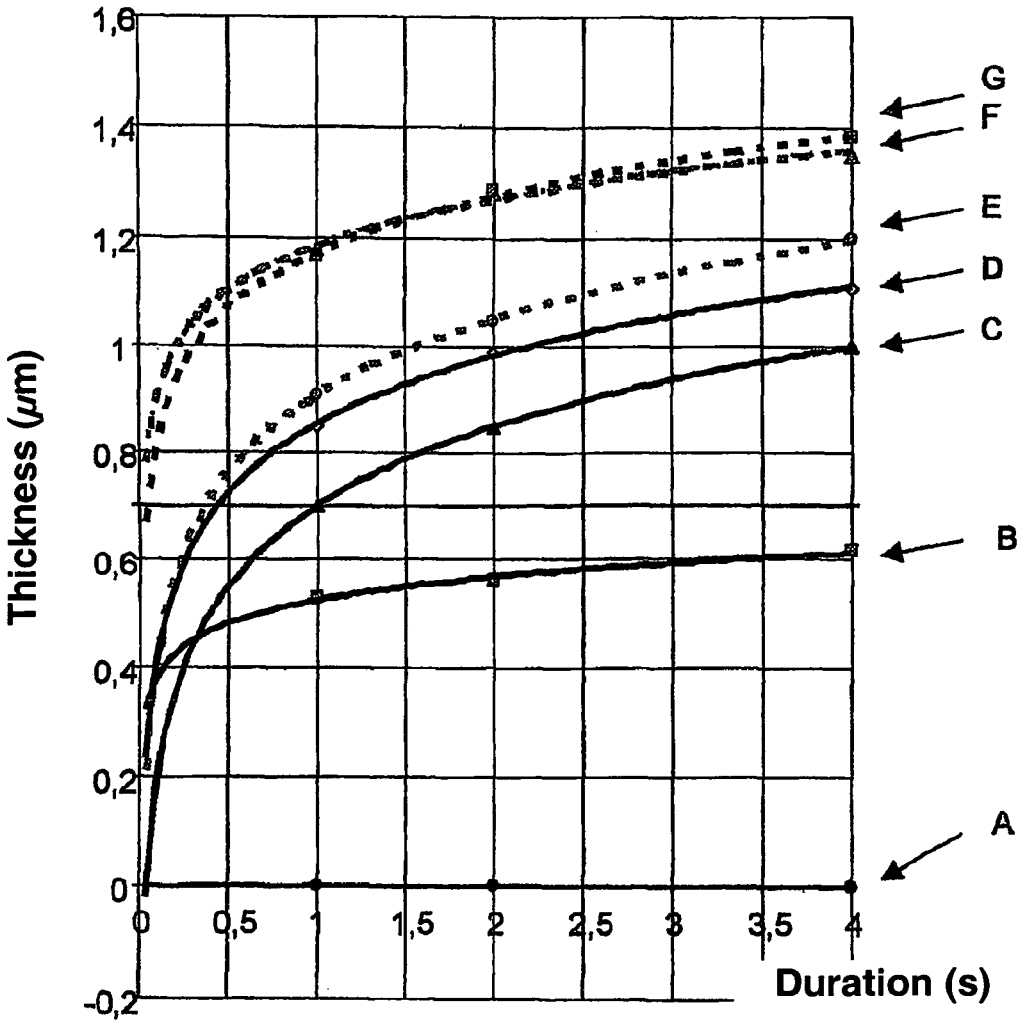

Note: Read all commas as decimals.

Note: Read all commas as decimals.

Note: Read all commas as decimals.

METHOD FOR OXALATING THE GALVANIZED SURFACE OF SHEET METAL

The invention concerns a method for depositing a zinc oxylate based layer onto a zinc based coating, excluding zinc-iron alloys, of galvanized sheet metal or metal strips, and the sheet metal or strips obtained by this method.

Oxalation is a process of surface conversion that has long been applied to metal surfaces, such as steel, zinc or aluminum, and is intended to form on the surface a oxalate based deposit the pre-lubrication properties of which facilitate cold forming.

The present invention specifically concerns the treating of galvanized surfaces, particularly those of so-called "carbon" steel sheets and strips. "Carbon steel" is understood as being a steel having a proportion of alloying elements that is distinctly less than what is found in stainless steels.

Generally, just after the step of oxalating the galvanized surface, the surface is coated with a thin film of oil (such as QUAKER6130, for example) in order to provide it with temporary protection against corrosion, so that sheet metal treated in this way can be stored for several weeks before it is ultimately formed.

The oxalation treatment of galvanized surfaces replaces the usual pre-phosphatizing treatment, and has the advantage of being free of any harmful consequences on the subsequent operations of assembly and painting performed at the customers' facilities, because it is completely eliminated during the degreasing operation that precedes the phosphatizing.

Thus, patent FR 1 066 186 (SOCIÉTÉ CONTINENTALE PARKER) describes a method for treating metals such as steel or zinc in a bath of an aqueous solution composed of:

- 1 to 120 g/L oxalic acid, that is, $10^{-2}$ to 0.3 mole/L,
- 0.2 to 50 g/L ferrous chloride $FeCl_2$ or ferric chloride $FeCl_3$, that is, $1.6\times10^{-3}$ to 0.4 mole/L of $Fe^{2+}$ or $1.2\times10^{-3}$ to 0.3 mole/L of $Fe^{3+}$, and
- 5 to 50 g/L of phosphate.

The examples indicate that the treatment times are on the order of one minute. The application of this solution to a metal surface with the help of this oxalate solution containing phosphates makes it possible to obtain coatings that have good adherence to the substrate and that facilitate cold forming. However, the presence of phosphates in the solution is not acceptable from an ecological point of view.

The document U.S. Pat. No. 2808138 (HOECHST) concerns a method of treating metal surfaces, such as stainless steel or zinc, by an aqueous solution composed of:

- 0.5 to 200 g/L oxalic acid, that is, $5\times10^{-3}$ to 2.2 mole/L,
- 0.5 to 15 g/L ferric ion $Fe^{3+}$, that is, $9\times10^{-3}$ to 0.27 mole/L, and
- 0.025 to 5 g/L of a soluble compound selected from among xanthates, dithiophosphoric acid esters, thioglycolic acid and thioureas. These compounds are no longer acceptable from an ecological point of view, and also produce a strong, disagreeable odor. The treatment times are on the order of five minutes.

Faced with environmental requirements, manufacturers have sought solutions for oxalating galvanized surfaces that are more environmentally friendly than those mentioned above. For this reason, phosphate, xanthates, dithiophosphoric acid esters, thioglycolic acid and thioureas contained in oxalation solutions of the prior art make up part of these compounds, the use of which must be limited by manufacturers as much as possible, or even eliminated, because of the problems related to their toxicity and reprocessing.

Only oxalic acid has no toxicity. Manufacturers have therefore developed processes implementing only oxalic acid solutions not containing any toxic compound.

The document U.S. Pat. No. 2,060,365 (CURTIN HOWE CORP.) concerns the treatment of galvanized surfaces by means of an aqueous solution composed of ferric oxalate $Fe_2(C2O_4)_3$ (1 to 10%, or 0.05 to 0.5 mole/L of $Fe^{3+}$) and free oxalic acid in sufficient quantity to inhibit the hydrolysis of the ferric salt. On page 1, column 2, lines 37 to 42, it is indicated that the solution is preferably 4 to 5% ferric oxalate (or 0.2 to 0.26 mole/L) and 0.5 to 1% oxalic acid (or $5\times10^{-2}$ to $10^{-1}$) mole/L oxalic acid. This forms a mixed layer of 66% ferric oxalate and 33% zinc oxalate on the galvanized surface, which is not suitable for forming the treated product. Moreover, in the presence of a corrosion agent such as a base, there is a decomplexation of the ferric oxalate and the ferric hydroxide is obtained according to the following reaction:

$$Fe_2(C_2O_4)_3+6OH^-\rightarrow 2Fe(OH)_3+3C_2O_4^{2-}$$

However, the ferric hydroxide has a rusty red appearance that will be unacceptable to customers.

On the other hand, the product resulting from a basic attack of a substrate coated with a layer of zinc oxalate, that is, zinc hydroxide, has a gray appearance that is not unfavorable.

Because the nature of the elements of a galvanized surface is quite different from those of a carbon or stainless steel surface, the reaction model of oxalation is different. On steel, a layer is obtained of ferrous oxalate $FeC_2O_4$ the behavior of which is similar to that of the zinc oxalate $ZnC_2O_4$, that is, it improves the drawability of the substrate treated in this way. However, because the oxalation reaction of a ferrous substrate is much slower than the oxalation reaction of a galvanized substrate, this reaction on steel is incompatible with current processing lines. In order to obtain oxalation reaction speeds on a ferrous substrate that are compatible with current line speeds, the only way consists of treating the substrate by anodic polarization. It is then necessary to work with a treatment facility equipped with an electrolysis cell and dedicated solely to oxalation, which represents a significant investment cost. In addition, the range of operation of this type of process is narrow. The iron must be oxidized to initiate the oxalation reaction, while preventing the simultaneous oxidation of the oxalic acid into $CO_2$, which considerably limits the accessible range in terms of deposit current density and makes the process difficult to control.

The two steps used in the oxalation treatment of galvanized sheet are:

1. The dissolving of the zinc: $Zn\rightarrow Zn^{2+}+2e^-$; for chemical dissolving in an acid medium, there would also be: $2H^++2e^-\rightarrow H_2$, or the overall reaction: $Zn+2H^+\rightarrow Zn^{2+}+H_2$.
2. The complexation of the ions formed and the precipitation of oxalate complexes of the $ZnC_2O_4$ type or others.

However, as has already been mentioned, because the formation of an iron oxalate layer is much slower than the formation of a zinc oxalate layer (assuming equal treatment conditions), it is more advantageous for a manufacturer to work with galvanized steel than with bare steel. Moreover, galvanized steel benefits from the corrosion protection provided by the zinc layer.

The oxalation of metal surfaces can be implemented by one of the following techniques: immersion, roll-coating or spraying.

The immersion technique consists of moving a strip of galvanized steel at high speed (80 to 100 m/min) through a vat containing a solution composed only of oxalic acid and possibly a wetting agent. When the oxalation treatment is done by immersion, the zinc oxalate deposit on the galvanized sheet is heterogeneous; in order to obtain a significant pre-lubrication effect on the sheet treated in this way, the thickness of the zinc oxalate layer must be more than about 0.7 $\mu$m, which corresponds to a GSM (grams per square meter) on the order of 2 g/m$^2$ of zinc oxalate. Now, with the strip moving at high speed (80 m/min), the treatment time allowing a layer of zinc oxide to be obtained that would improve the cold formability of the surface treated in this way is very short, on the order of 1 to 5 seconds. This is the reason highly concentrated solutions of oxalic acid are used, of between 0.3 and 0.8 mole/L, so as to obtain zinc oxalate layers on the substrate that are sufficiently thick. However, highly concentrated oxalic acid solutions have the disadvantage of being aggressive with respect to the treatment facility. Indeed, the vats containing the treatment solution are generally made of stainless steel. To avoid this problem, much weaker solutions of oxalic acid could be used (concentrations of less than 0.3 mole/L). However, the reaction time to obtain a layer of zinc oxalate on the galvanized surface is much longer, and in this case:

- either the treatment line must be slowed down, to the detriment of overall production; or
- much longer treatment vats are used, which represents additional investment costs, and also is not always possible because of the amount of space required.

After application of this solution, the sheet can be rinsed and dried in the standard way. It then receives a fine coating of oil of the type QUAKER6130 to provide temporary protection against corrosion.

Thus, when working with highly concentrated solutions for a very short time, the oxalation reaction of the galvanized surface is very fast and complete. The layer of zinc oxalate obtained, whether it is rinsed or not, has no degradation of properties with respect to temporary resistance to corrosion. However, there is the problem of the aggressiveness of the acid bath as concerns the facilities.

Furthermore, when working with solutions in weak concentrations for a long enough time to have a complete oxalation reaction, there is still no degradation of properties with respect to temporary resistance to corrosion (whether the product is rinsed or not). The problem here lies in treatment times that are too long and incompatible with a high speed process.

The problem is aggravated even more when working with solutions of weak concentrations for short time periods. This results in two problems:

- the length of the treatment is not long enough to achieve the gain expected in drawing, whether the product is rinsed or not;
- the conversion reaction is not complete; thus, the oxalate deposit includes oxalic acid that has not reacted with the zinc, but which is going to react with the coating of oil that the product is going to receive, if it is not eliminated by rinsing. In this case, the performance of the oil is seriously deteriorated. This being the case, whether the product is rinsed or not, the deposited layer is not thick enough to result in an improvement in the drawability of the product.

The roll-coating technique consists of moving a strip of galvanized steel at high speed (80 to 100 m/min) between two rotating coating rollers that dip into two vats containing a solution that includes only oxalic acid with the possible addition of a wetting agent. In this case, the thickness of the zinc oxalate layer is governed by the quantity of material deposited by the rollers, and therefore by the roller-sheet distance, and the time of application of the oxalic acid solution is also very short, on the order of a second. The application of the treatment solution by roll-coating without rinsing prior to drying allows a more homogeneous distribution of the conversion layer than application of the solution by immersion, and GSM's of less than 0.5 g/m$^2$, and 0.1 g/m$^2$ or less, can then be enough to obtain the optimal pre-lubricant properties. In this case, the concentration of the oxalic acid solutions is between 0.3 and 0.8 mole/L, in order to obtain zinc oxalate layers on the substrate that are thick enough.

However, the use of highly concentrated oxalic acid solutions has disadvantages:

- on the one hand, as has already been seen, concentrated acid solutions are aggressive with respect to the treatment facility; the treatment vats are usually stainless steel, and the rollers for coating the solution are made of rubber or polyurethane;
- on the other hand, immediately after the roll-coating of the moving strip, the zinc oxalate coating thus formed is dried by dryers at 180° C. placed just beneath the treatment vats. The heat released by the dryers causes an evaporation of the aqueous solutions of oxalic acid contained in the vats, followed by the precipitation of the oxalic acid. Thus very quickly solutions are obtained that have a milky appearance and are unsuitable for the oxalation reaction desired. The production line must therefore be shut down, and the vats cleaned and refilled with a clean oxalic acid solution.

Most industrial lines for coating by roll-coating or immersion do not provide a rinsing before drying step, because that would considerably increase the cost of the oxalation treatment. Indeed, the line would have to be equipped with rinse vats, which is not always possible because of the amount of space required, but especially because the rinse effluents would have to be reprocessed. Therefore, the solution to use aqueous compositions with low concentrations (<0.3 mole/L) of oxalic acid, which would make it possible to avoid the above-mentioned disadvantages, can not be implemented. Because the oxalation reaction becomes too slow, the oxalic acid does not react completely with the zinc and a layer is deposited that contains, in addition to the zinc oxalate ($ZnC_2O_4$), oxalic acid that has not reacted, and an intermediate complex such as $Zn(HC_2O_4)_2$. These entities react, through their free carboxylic acid functions, with the oil with which the treated sheet will subsequently be coated. This affects the temporary resistance to corrosion of sheet treated in this way.

Although the solutions mentioned above are environmentally friendly, they are very restrictive and unsatisfactory from an economic point of view, in that they rapidly damage the facilities and require frequent shut-downs of the treatment line.

With respect to the above-mentioned oxalation reaction scheme, it appears that stage 2 oxalation can only occur if stage 1 dissolving has already been started, which is a standard, general model for conversion treatments. In order to increase the speed of oxalation to a level compatible with the speed of movement of the steel sheet in industrial facilities, it is advisable to increase the speed of dissolving the zinc (stage 1) while maintaining the precipitation conditions of the oxalate (stage 2). Thus, if criteria are established concerning the minimum speed of oxalation and the minimum GSM of the deposit, the range of concentration of oxalic acid can be determined, particularly in an experimental way, that the treatment solution should have in order to meet these criteria; this range determines the "range of operation" of the treatment, which should be as broad as possible to simplify the control of the industrial conditions of surface treatment by oxalation.

A first solution for increasing the speed of oxalation would consist of creating more oxidizing conditions by adding large quantities of oxygenated water or by electrochemical polarization, which is economically disadvantageous. U.S. Pat. No. 5,795,661 (BETHLEHEM STEEL) thus describes the advantage of an oxalation treatment for the pre-lubrication of galvanized sheet, particularly within the scope of forming these sheets, by means of an aqueous solution composed of oxalic acid and oxygenated water.

However, the use of large quantities of oxygenated water in industrial facilities poses process control problems related to the stability of the oxygenated water, which is transformed into water and dilutes the bath, as well as serious corrosion and safety problems.

A second solution would consist of decreasing the pH and increasing the concentration of oxalic acid. Unfortunately, this solution has the disadvantages of decreasing the "range of operation" described above, seriously complicating the control of the industrial conditions of application of the treatment.

Moreover, the fact has already been mentioned that, if oxalic acid solutions are used in low concentrations, the oxalation reaction is not fast enough and the oxalic acid does not have time to react completely with the galvanized surface of the sheet. Thus a layer is obtained of a mixture of zinc oxalate, of a $Zn(HC_2O_4)_2$ type complex and residual oxalic acid. When this surface is subsequently protected temporarily against corrosion by a layer of oil, the oil reacts with the residual acid functions. This results in poor temporary resistance to corrosion of the surfaces thus treated.

The purpose of the present invention is therefore to make available a method allowing galvanized steel strips to be treated by means of ecological oxalation solutions, so as to obtain deposits of zinc oxalates having good pre-lubrication properties (therefore, sufficient thickness), while significantly increasing the speed of oxalation, and while avoiding or limiting the above-mentioned disadvantages.

To that end, a purpose of the invention is to form a zinc oxalate layer on the surface of a metal strip or sheet coated with a layer of zinc or zinc alloy, with the exception of zinc-iron alloys, by means of an aqueous oxalation solution containing oxalic acid, characterized in that said solution is an aqueous solution of oxalic acid in a concentration of between $5\times10^{-3}$ and 0.1 mole/L incorporating at least one compound and/or one ion of a zinc oxidizing metal in a concentration of between $10^{-6}$ and $10^{-2}$ mole/L, and possibly a wetting agent.

In any case, the concentration in oxidizing ions is less than the concentration threshold at which precipitations of the respective metal are observed.

The invention can also have one or more of the following characteristics:

- the concentration of oxalic acid is preferably between $5\times10^{-3}$ and $5\times10^{-2}$ mole/L.
- the concentration of compounds and/or oxidizing ions of the zinc in said solution is preferably between $10^{-6}$ and $10^{-3}$ mole/L.
- at least one ion is chosen from the group comprised of $Ni^{2+}$, $Co^{2+}$, $Cu^{2+}$, $Fe^{2+}$, $Fe^{3+}$, $Mo^{3+}$, $Sn^{2+}$, $Sn^{4+}$.
- said solution is applied to said galvanized surface without electrical polarization of said sheet.
- the GSM of said zinc oxalate layer is between 0.05 and 3 $g/m^2$.

A purpose of the invention is also a method of lubricating and temporarily protecting a galvanized sheet, characterized in that it has a step of surface oxalation treatment according to the invention, followed by a step of application of a layer of oil.

Preferably, in the implementation of this lubrication process:

- said oil has at least one fatty ester and/or calcium carbonate in a proportion of 5% or more.

A purpose of the invention is also a method of drawing a galvanized sheet, characterized in that it includes, prior to the drawing, a step of lubrication according to the invention.

Finally, a purpose of the invention is a metal strip or sheet that is coated with a layer of zinc, then coated with a zinc oxalate based layer obtained by the oxalation method according to the invention, characterized in that said oxalate layer has at least 99% zinc oxalate.

The invention will be better understood from the following description, given by way of non-limiting example.

Quite unexpectedly, the inventors have demonstrated that by adding a very small quantity of a compound and/or an ion of a metal that can oxidize zinc in the oxalation solution according to the invention, a layer of zinc oxalate is obtained on the galvanized surface of the steel sheets or strips treated by said oxalation solution, the thickness of which is sufficient to give the sheet or strip thus treated good temporary protection against corrosion and good pre-lubrication properties.

A galvanized surface of a steel sheet or strip is understood as being a surface coated essentially with zinc, or a zinc-based alloy, with the exception for this invention of zinc-iron alloys.

In the case of the oxalation treatment according to the invention of a sheet coated with a layer of zinc, the inventors have demonstrated that the conversion layer obtained would include at least 99% zinc oxalate.

The concentration in compounds and/or zinc oxidizing metal ions is between $10^{-6}$ and $10^{-2}$ mole/L, preferably between $10^{-6}$ and $10^{-3}$ mole/L.

For a concentration of metal ions of less than $10^{-6}$ mole/L, the effect of these ions on the speed of oxalation is not significant.

For a concentration of metal ions of $10^{-2}$ mole/L or more, the chemical deposit is assisted by the carburizing of the metal element corresponding to these ions, at the expense of the oxalation desired.

For oxalation baths with an oxalic acid concentration of more than 0.1 mole/L, the use of these metal ions is not always essential to accelerate the oxalation reaction, except, for example, in the case of application by roll-coating to quickly obtain a complete reaction of the treatment solution with the surface. In particular for oxalation baths with an oxalic acid concentration of less than 0.05 mole/L, the addition of these ions in low concentration in the treatment solution is an effective and economical means of obtaining industrially viable oxalation kinetics by immersion. The invention therefore applies to oxalation baths with an oxalic acid concentration of between $5\times10^{-3}$ and 0.1 mole/L, preferably between $5\times10^{-3}$ and $5\times10^{-2}$ mole/L.

By means of the zinc oxidizing metal ions, even in small concentrations, a very high speed of oxalation is thus obtained, not only when the oxalic acid concentration is less than 0.05 mole/L, but also even when the solution does not contain an oxidizer like oxygenated water in significant quantities and/or even if the sheet is not polarized; the treatment facility is therefore more economical and easier to operate.

Table I describes oxalation baths of comparable performance. Compared to the baths of the prior art, it can be seen that the bath according to the invention has a lower oxalic acid concentration or does not contain oxygenated water.

TABLE I

| Oxalation Solution | Oxalation baths with comparable drawability performances | | |
|---|---|---|---|
| | U.S. Pat. No. 5,795,661 | Industrial Practices | Invention |
| Oxalic acid: | 7 to 14 g/L | 27 to 72 g/L | 9 g/L ≈ 0.1 mole/L |
| Oxygenated water: | 2 to 4 g/L | None | None |
| Zinc oxidizing metal ions | None | None | $10^{-3}$ mole/L ($Ni^{2+}$) |

Preferably, a metal ion is chosen from the group of ions listed in Table II. This table also indicates the value of the normal potential of the oxidation-reduction couple (ion/corresponding metal element or other ion) in volts (V) compared to the Normal Hydrogen Electrode (NHE).

TABLE II

Ions usable in oxalation solutions according to the invention

| Ions | Couple | Potential | Ions | Couple | Potential |
|---|---|---|---|---|---|
| | Redox | V/NHE | | Redox | V/NHE |
| $Ni^{2+}$ | $Ni^{2+}/Ni$ | −0.26 | $Fe^{3+}$ | $Fe^{3+}/Fe$ | −0.037 |
| $Co^{2+}$ | $Co^{2+}/Co$ | −0.28 | $Mo^{3+}$ | $Mo^{3+}/Mo$ | −0.20 |
| $Cu^{2+}$ | $Cu^{2+}/Cu$ | +0.34 | $Sn^{2+}$ | $Sn^{2+}/Sn$ | −0.14 |
| $Fe^{2+}$ | $Fe^{2+}/Fe$ | −0.44 | $Sn^{4+}$ | $Sn^{4+}/Sn^{2+}$ | −0.151 |

Finally, the oxalation treatment bath can include wetting agents and the inevitable impurities.

In order to apply the treatment solution containing the metal ions so as to obtain a deposit of zinc oxalate on the galvanized surface of the sheet, the standard procedure is used, for example by immersion, spraying or roll-coating; the application stage is followed by a drying stage. Between the application stage and the drying stage, the treated sheet can be rinsed.

The optimal composition of the bath (concentrations of oxalic acid and metal ions) and the morphology of the oxalate-based deposit obtained depend on the conditions of application. These conditions are adapted in a known way to obtain the GSM of oxalate-based deposit needed to obtain the desired properties, for example pre-lubrication properties.

In order to obtain a significant pre-lubrication effect on a galvanized sheet, when the oxalation treatment is done by immersion, the minimum necessary thickness is on the order of about 0.7 $\mu$m, which corresponds to a GSM on the order of 2 g/m$^2$ of zinc oxalate. The application of the treatment solution by roll-coating without rinsing before drying makes it possible to achieve a more homogeneous distribution of the conversion layer and GSM's of less than 0.5 g/m$^2$, and even GSM's of 0.1 g/m$^2$ or less, can then be sufficient to obtain optimal pre-lubrication properties.

The oxalate-based deposit obtained on the galvanized surface of the sheet offers properties that are comparable to those of standard oxalate-based deposits of the prior art, at least in the following ways:

- comparable pre-lubrication effects: absence of chattering under friction, appreciable decrease in the coefficient of friction (>50%) compared to the same oiled sheet without prior oxalation.
- easy degreasability in an alkaline medium, oxalate deposit easy to eliminate, making it possible, for example, to carry out a phosphatizing treatment under very good conditions.

The method according to the invention allows the "range of operation" of the treatment to be extended, that is, the range of oxalic acid concentrations that allow a sufficiently pre-lubrication deposit to be obtained. For example:

- if the range is between 0.3 and 0.8 mole/L oxalic acid without adding zinc oxidizing ions,
- the range obtained by adding zinc oxidizing ions according to the invention is between $5\times10^{-3}$ and 0.8 mole/L.

This effect facilitates the management of the oxalation baths in industrial applications.

The invention, therefore, makes it possible to obtain oxalate deposits on galvanized sheets:

- at higher speeds, without using large quantities of oxidizer such as oxygenated water and/or without polarization of the sheet,
- and/or by using solutions with lower oxalic acid concentrations than in the prior art.

As illustrated in the examples given below, by random comparative measurements of potential of galvanized sheets immersed in different oxalation solutions:

- In the presence of oxalic acid alone, a slight slowing is observed before a fully covering layer of zinc oxalate is obtained, which reflects an inhibition phenomenon in the formation of a deposit on the galvanized coating; it is also observed that this slowing becomes shorter as the oxalic acid concentration is increased.
- In the presence of zinc oxidizing metal ions according to the invention, a very significant decrease, and even disappearance, of the inhibition phenomenon is observed (see FIG. 3).
- In the presence of metal ions other than zinc reducing agents, contrary to the invention, an aggravation of this inhibition phenomenon is observed.

The important activity of the zinc oxidizing ions in low concentration indicates a catalyzing effect that impedes the temporary inhibition of formation of the oxalate layer.

The oxalation treatment of galvanized sheets according to the invention can be used for all of the usual oxalation applications, such as those described in the introduction, particularly for the pre-lubrication of these sheets.

Observed under a scanning electron microscope, the deposit obtained is in the form of cubic crystals, or in the case of thicknesses of less than 0.1 $\mu$m, in the form of fine flakes. The average size of these crystals can be quite different, in particular depending on the application conditions of the treatment solution:

0.1 to 0.5 $\mu$m for a deposit applied by roll-coating, 0.5 to 0.8 $\mu$m for a deposit applied by immersion.

In an analysis by Glow Discharge Spectroscopy ("GDS") of an amount of carbon in different deposits, which serves as a tracer element for the oxalate, it is found that the deposit, according to the invention, has about twice the amount of carbon than a deposit made under the same conditions but without the addition of a zinc oxidizing metal ion to the oxalation solution (analyses based on deposits made with an oxalation solution containing 0.1 mole/L of oxalic acid).

An analysis of the ejected ions by sputtering and Secondary Ion Mass Spectroscopy (SIMS) reveals the presence of zinc oxidizing ions ($Ni^{2+}$) in the deposit, as illustrated in example 3. These ions are not detectable by x-ray photoelectron spectroscopy on the outer surface of the deposit; these ions are no longer detectable in the thickness by chemical analysis.

Compared to deposits obtained without the addition of zinc oxidizing ions in the oxalation solution, a greater proportion of oxidized zinc as $Zn^{2+}$ was verified by SIMS throughout the deposit, which would explain the darker color of the deposit according to the invention, and illustrates the greater thickness of the deposited layer.

Other advantages of the method of the invention will appear from the description presented below as non-limiting examples of the present invention.

Materials:

1) Galvanized Steel Sheet Used:

USICAR™ galvanized steel sheet, coated by electroplating with a zinc layer about 7.5 μm thick, degreased in an alkaline medium.

2) Oxalation Bath:

Oxalic acid concentration: variable.

Nature and concentration of metal ions added: variable.

Other components: none.

Methods:

1) Conditions Under Which the Deposit was Made:

Bath temperature: unless otherwise indicated, ambient temperature (about 25° C.).

Application method: immersion followed by rinse with decarbonated water, or by roll-coating without rinsing before drying.

Drying method: hot air.

Surface density of the dried deposit obtained: unless otherwise indicated, 2 g/m$^2$ by immersion (or about 0.7 μm), 0.1 to 0.3 g/m$^2$ by roll-coating.

2) Evaluation of the Pre-lubrication Effect:

The tribological behavior of surfaces of galvanized steel test samples treated and untreated by oxalation was evaluated by measuring the coefficient of friction as follows:

before the friction test, the test sample is first oiled in the usual way, unless otherwise indicated, with QUAKER 6130 oil, the friction test is done with a standard flat-on-plate tribometer under a clamping pressure increasing from 0 to 800×10+5 Pa; the measurement used generally corresponds to the average of the friction coefficients measured during the test.

3) Evaluation of the GSM of the Oxalate Base Deposit:

This is done in two steps:

with a galvanized steel test sample treated by oxalation, the first step is to dissolve the deposit and the underlying zinc layer, using the solution obtained, the second step is to measure the quantity of oxalic acid contained in the solution.

This quantity is compared to the treated surface area to obtain the GSM.

1st Step: Using a set-up with three electrodes (the treated galvanized steel test sample, a stainless steel secondary electrode, and a saturated calomel electrode "SCE" for reference), electro-dissolution of the deposit and of the zinc coating is carried out by applying a potential of −800 mV/SCE to the treated galvanized steel test sample; when the current ceases, all of the zinc is considered to have gone into solution in the electrolyte; in the solution thus obtained, which has a very acid pH, the zinc oxalate is considered to be completely decomplexed according to the reaction:

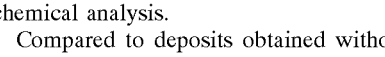

$$2H^+ + ZnC_2O_4 \rightarrow Zn^{2+} + H_2C_2O_4$$

2nd Step: In the solution obtained, a few drops of manganese sulfate are added to catalyze the oxidation-reduction reaction. The amount of $H_2C_2O_4$ oxalic acid is then measured by a solution of potassium permanganate of known normality, according to the reactions:

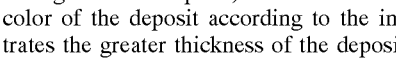

oxidation of the oxalic acid:

$$H_2C_2O_4 \rightarrow 2CO_2 + 2H^+ + 2e^-$$

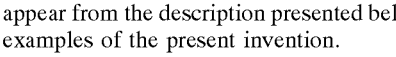

reduction of the permanganate:

$$MnO_4^- + 8H^+ + 5e^- \rightarrow Mn^{2+} + 4H_2O$$

While the permanganate is being added, the change in the solution's potential is measured between a platinum electrode and a saturated calomel electrode. The jump in potential corresponds to the equivalent amount according to the formula $N_o \times V_o = N \times V_{eq}$, where No is the normality of the oxalic acid solution to be titrated, $V_o$ is the volume of this solution to be titrated, N is the normality of the permanganate titration solution, and $V_{eq}$ is the volume of this titration solution added to bring about the jump in potential.

Starting with $N_o$, from the volume of the electro-dissolution solution, from the treated surface area of the test sample, the surface density of the oxalate-based deposit on the initial test sample and/or the average thickness of this deposit is calculated in a known way.

4) Characterization of Corrosion from Moisture/Heat (DIN Standard 51160)

The samples to be tested are placed in a climatic condition reproducer corresponding to DIN 51160, which simulates the corrosion conditions of an outer turn of a spool of sheet metal or of a sheet cut to length during storage.

The detail of the cycle (one cycle =24 hours) under controlled moisture/heat conditions is described below:

8 hours at 40° C. and 100% relative humidity 16 hours at ambient temperature and humidity The test samples are individually suspended vertically.

Visual observation of the test samples makes it possible to quantify the degradation of the coating by the appearance of white rust, based on the number of successive cycles of exposure. The ratings are stopped when at least 10% of the total surface of the test sample show signs of white rust.

COMPARATIVE EXAMPLE 1

The purpose of this example is to illustrate, with reference to FIG. 1, the change in immersion oxalation speed of a galvanized sheet based on the oxalic acid concentration of the treatment bath and/or based on the temperature of the bath.

FIG. 1 represents the variation in thickness of an immersion deposit of zinc oxalate (μm) as a function of the duration of the oxalation treatment, i.e., the duration of immersion(s), for different oxalic acid concentrations of 0.1, 0.3, 0.5 and 0.8 mole/L, and two temperatures 25° C. and 50° C., that is, a total of eight curves (the curves for 0.1 mole/L at 25° C. and 50° C. are merged).

The results obtained are shown in FIG. 1 for the following treatment solutions and temperatures:

A: $[H_2C_2O_4]$=0.1 mole/L at 25° C. or 50° C.

B: $[H_2C_2O_4]$=0.3 mole/L at 25° C.

C: $[H_2C_2O_4]$=0.5 mole/L at 25° C.

D: $[H_2C_2O_4]$=0.8 mole/L at 25° C.

E: $[H_2C_2O_4]$=0.3 mole/L at 50° C.

F: $[H_2C_2O_4]$=0.5 mole/L at 50° C.

G: $[H_2C_2O_4]$=0.8 mole/L at 50° C.

In order to obtain a significant pre-lubrication effect in the case of the immersion application, routine tests have shown that the thickness of the zinc oxalate deposit should be about 0.7 $\mu$m or more.

According to the curves in FIG. 1, for a duration of treatment of 0.5 sec., it is observed that this thickness of 0.7 $\mu$m is reached:

at 25° C., as soon as $[C_2O_4^{2-}] \geqq 0.8$ mole/L, at 50° C., as soon as $[C_2O_4^{2-}] \geqq 0.3$ mole/L.

It is evident, therefore, that to obtain a high oxalation speed without electrical polarization of the sheet to be treated and without oxidizing the zinc at a high concentration, solutions should be used with an oxalic acid concentration that is considerably greater than 0.1 mole/L, at least: 0.3 mole/L at 50° C., 0.8 mole/L at 25° C.

Figure 2A:
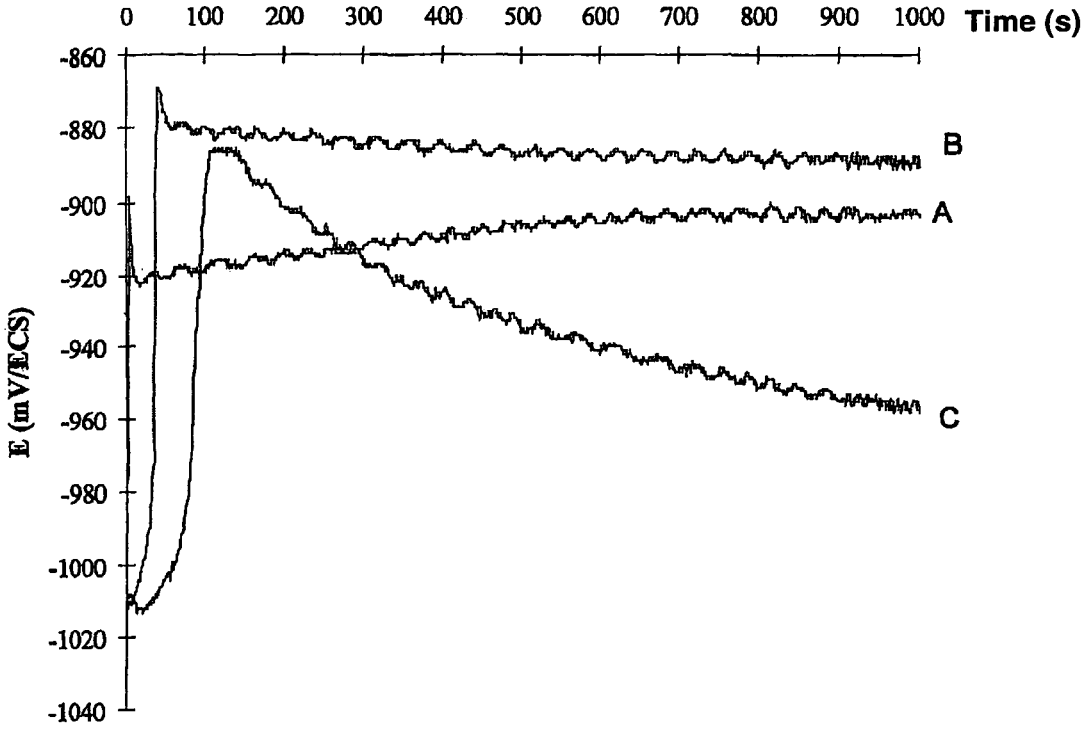
Figure 2B:
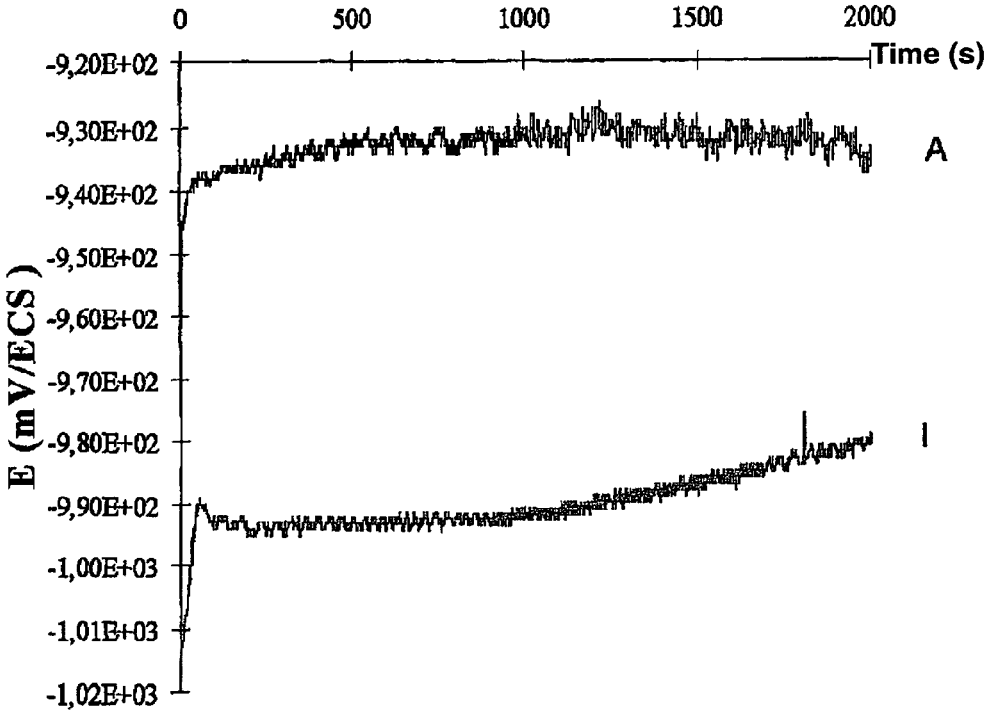
Figure 3:
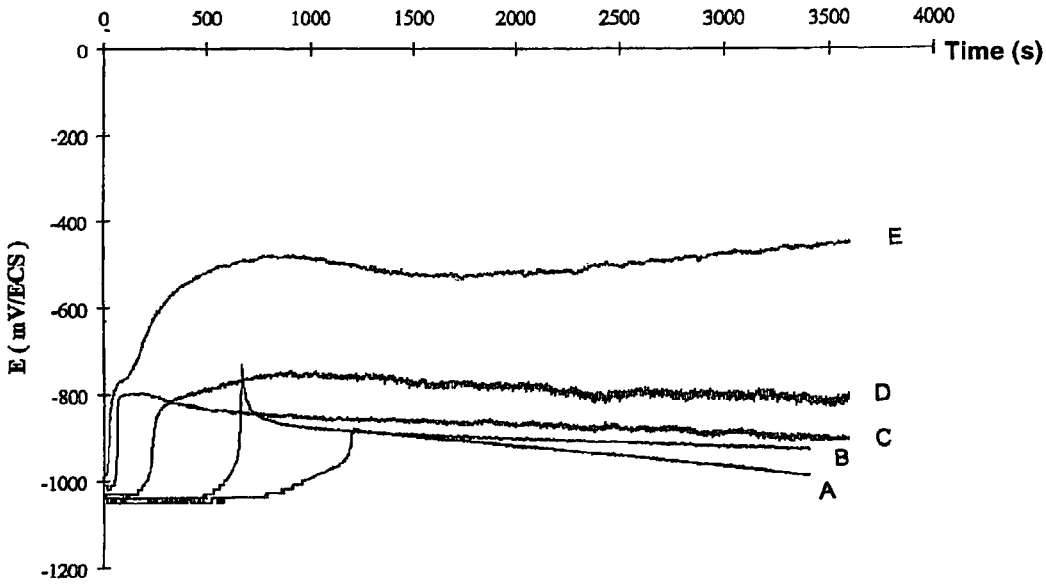

FIGS. 2A, 2B and 3 illustrate examples 1 and 2. The random potential (y-axis) (measured in mV with respect to a Saturated Calomel Electrode: "SCE") of a galvanized steel sheet as a function of time (s) (x-axis), measured from the moment of immersion of the sheet (zero time) by chronopotentiometry at nearly-nul current.

EXAMPLE 1

The purpose of this example is to illustrate, according to the invention, the effect of adding, in very weak concentration, $Ni^{2+}$ ions to the treatment solution on the oxalation speed of the galvanized sheet, using here—again by immersion—different treatment solutions at 25° C. containing the same proportion of 0.5 mole/L oxalic acid. The $Ni^{2+}$ ions are zinc oxidizing.

In order to continuously evaluate the oxalation speed of an oxalation solution, the potential of the galvanized steel sheet is randomly measured starting at the moment (zero time) immersion of the sheet in said solution begins. The steel sheet electrode is in the form of a circular disk with surface area of 0.2 $cm^2$. During the measurement, the electrode is driven in rotation at 1250 revolutions per minute.

The results obtained are shown in FIG. 2A for the following treatment solutions:

C=comparative: $[H_2C2O_4]$=0.5 mole/L with no addition of ions,

A: $[H_2C2O_4]$=0.5 mole/L and $[NiCl_2]=10^{-3}$ mole/L

B: $[H_2C2O_{4]=0.5}$ mole/L and $[NiCl_2]=10^{-4}$ mole/L

The curve C (comparative) is for a solution of the prior art, without the addition of zinc oxidizing ions. It shows a first phase of a steady increase of the potential for up to about 100 seconds, followed by a second phase of slow, steady and slight decrease. In the first phase, it can be seen that the oxalation speed is very weak in the first moments, then steadily increases (increase of the slope of the curve). This very weak oxalation reveals a temporary inhibition phenomenon of the galvanized surface that the invention specifically makes it possible to limit.

Curves A and B are for solutions according to the invention, containing zinc oxidizing ions. They show that the oxalation is nearly instantaneous, which indicates that very small quantities of $Ni^{2+}$ ions added to the solution make it possible for this inhibition phenomenon to be limited or even eliminated, for the reactivity of the galvanized surface to be to considerably increased, and for the oxalation speed to be very strongly increased.

FIG. 2B shows that this effect results from a synergy between the $C_2O_4^{2-}$ ions and the $Ni^{2+}$ ions; the results listed are for the following treatment solutions:

A: $[H_2C2O_{4]=0.5}$ mole/L and $[NiCl_2]$=0.001 mole/L

I: a solution that contains only a weak concentration of zinc oxidizing ions, with no oxalic acid: $[NiCL_2]$ =0.001 mole/L.

From the results listed for this figure, it can be clearly seen that the $Ni^2$+ions alone do not have an effect that is comparable to that of the $C_2O_4^{2-}$+$Ni^{2+}$ ions.

EXAMPLE 2

The purpose of this example is to illustrate that only ions that are zinc oxidizing, even in small concentrations, produce this synergistic effect and make it possible to increase the oxalation speed.

As in example 1, random measurement of the potential of the same galvanized steel sheet immersed in the treatment solution to be evaluated is used.

In order to better differentiate the effect of the metal ions added to the solution on the speed of oxalation, the solutions used here contain only 0.05 mole/L of oxalic acid, again at 25° C.; For all of the solutions (except for the reference B), the concentration of added ions is $10^{-3}$ mole/L.

FIG. 3 shows the curves of change in random potential pertaining to the following treatment solutions:

A: $[H_2C_2O_4]=5\times10^{-2}$ mole/L and $[MnCl_2]=10^{-3}$ mole/L

B =reference: $[H_2C_2O_4]=5\times10^{-2}$ mole/L

C: $[H_2C_2O_4]=5\times10^{-2}$ mole/L and $[NiCl_2]=10^{-3}$ mole/L

D: $[H_2C_2O_4]=5\times10^{-2}$ mole/L and $[CoCl_2]=10^{-3}$ mole/L

E: $[H_2C_2O_4]=5\times10^{-2}$ mole/L and $[CuCl_2]=10^{-3}$ mole/L

The $Cu^{2+}$, $Co^{2+}$ and $Ni^{2+}$ ions are zinc oxidizing and are therefore usable for the invention, while the $Mn^{2+}$ ions are not zinc oxidizing and are not usable for the invention.

The normal oxidation-reduction potentials of the couples (metal ions/- corresponding metal with respect to the normal hydrogen electrode are:

$E_0$ $(Cu^{2+}/Cu)$=+0.34 V $E_0$ $(Ni^{2+}/Ni)$=−0.26 V $E_0$ $(Co^{2+}/Co)$=−0.28 V

For reference: $E_0$ $(Zn^{2+}/Zn)$=−0.76 V $E_0$ $(Mn^{2+}/Mn)$=−1.18 V

By comparing the curves of FIG. 3 and these oxidation-reduction values, it clearly can be seen that the acceleration action of the metal ion on the oxalation speed is particularly pronounced when this ion is zinc oxidizing. The reverse is true for the $Mn^{2+}$ ion, which is a reducing agent and outside the field of the invention. It has a slowing effect on the oxalation.

EXAMPLE 3

The purpose of this example is to find in which concentration domain the zinc oxidizing ion added to the treatment solution is effective in catalyzing and accelerating the oxalation of the galvanized surface.

As in example 2, the curves show the random potential of a galvanized steel electrode in solutions having 0.05 mole/L of oxalic acid and different concentrations of $NiCl_2$ spaced out between $10^{-7}$ and $10^{-1}$ mole/L. It can be seen that the catalytic effect of the $Ni^{2+}$ ions is produced as soon as the $NiCl_2$ concentration reaches $10^{-6}$ mole/L. This effect is always observed for greater concentrations, up to $10^{-2}$ mole/L. Beyond that concentration, a chemical nickel deposit can be observed with the naked eye.

EXAMPLE 4

The purpose of this example is to illustrate the physical-chemical characteristics of the deposit according to the invention that differentiate it from an oxalation deposit done according to the prior art (reference).

The analytical method used to determine these differences is Secondary Ion Mass Spectroscopy ("SIMS") of the ions ejected from the oxalate deposit by ionic bombardment.

Figure 4:
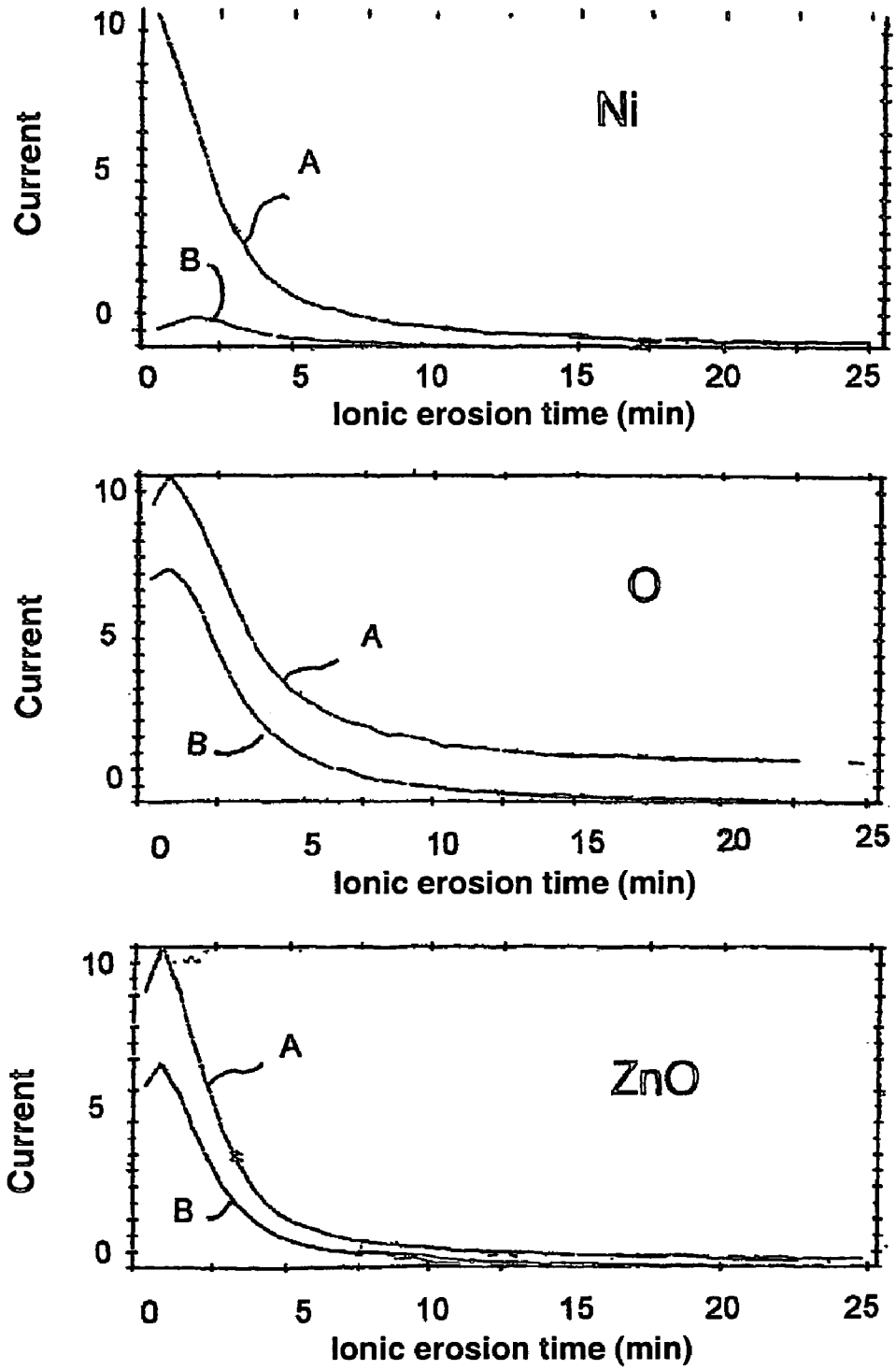

FIG. 4 illustrates, from top to bottom, the profiles of $Ni^{+}_{58}$, $O^{-}_{16}$ and $ZnO^{+}_{80}$ obtained by Secondary Ion Mass Spectroscopy ("SIMS") on an oxalate based deposit produced according to the invention (A curves) and on a deposit produced under the same conditions but without the addition of oxidizing metal ions (B curves); the curves indicate the intensity of the signal as a function of the sputter time (0 to 25 minutes), that is, as a function of the depth from the outermost surface.

FIG. 4, divided into three parts that are referenced, from top to bottom, "Ni", "O" and "ZnO" show the results obtained respectively for three types of ions: $Ni^{+}_{58}$, $O^{-}_{16}$ and $ZnO^{+}_{80}$; on each part two curves or profiles are indicated: curves A for a deposit produced according to the invention in the presence of nickel ions, curves B for a reference deposit produced under the same conditions but without the addition of nickel ions.

The sputter time is extended to 25 minutes and corresponds to a depth on the order of about 1 to 1.5 $\mu$m.

It is determined from these results that:

- the nickel added to the oxalation bath is present in the thickness of the deposit made in the presence of $Ni^{2+}$ at a concentration at least 5 times greater than in the thickness of the reference deposit; the nickel detected in the reference deposit corresponds to the nickel in the inevitable impurities present in the bath.
- the addition of $Ni^{2+}$ to the oxalation bath increases the proportion of zinc in $Zn^{2+}$ oxidized state in the deposit, which confirms that this addition promotes the dissolving and oxidation of the zinc (as $Zn^{2+}$) of the surface to be treated and makes it possible to increase the thickness of the deposited layer.

EXAMPLE 5

The purpose of this example is to illustrate the possible synergies between the oxalate base deposit and a lubrication oil, particularly in the case where this oil contains fatty esters and/or calcium carbonate.

Fatty esters are standard components of lubricating oils. Calcium carbonates are standard additives for these oils, dispersed and emulsified in the oil phase, generally with the aid of alkyl sulfonates or alkyl-aryl sulfonates. The usual term for this mixture is "overbased calcium sulfonate."

The QUAKER 6130 oil used in the procedure to evaluate the pre-lubrication effect (point 2, METHODS paragraph above) contains, in addition to olefinic or paraffinic mineral oil, both of the following components: about 16% fatty esters and about 5% calcium carbonate.

Friction tests are carried out (point 2, METHODS paragraph above, in this instance with a constant clamping pressure of $400\times10^{+5}$ Pa) on galvanized test samples that have not been treated by oxalation, and on test samples treated by roll-coating according to the invention so as to obtain an oxalate base with a GSM on the order of 0.3 g/m$^2$.

Prior to the friction test, the samples are coated:

- with pure mineral oil not containing any fatty esters or calcium carbonate (SHELL 2881 oil);
- or QUAKER 6130 oil,
- or a layer of calcium carbonate, applied by roll-coating a solution of overbased calcium sulfonates diluted in hexadecane;
- or a layer of fatty ester, also applied by roll-coating a solution of methyl oleate (fatty ester) diluted in hexadecane;

For the friction tests, the minimum friction coefficient ($\mu_{min}$) at the end of the test is measured; the results obtained are shown in Table III.

TABLE III

Friction Results

| | Oil Used | $\mu_{min}$ |
|---|---|---|
| Untreated surface | SHELL 2881 oil | 0.19 |
| | Calcium carbonate | 0.25 |
| | Fatty ester | 0.25 |
| | QUAKER 6130 oil | 0.16 |
| Treated surface (invention) | SHELL 2881 oil | 0.14 |
| | Calcium carbonate | 0.1 |
| | Fatty ester | 0.1 |
| | QUAKER 6130 oil | 0.09 |

It is obvious, therefore, that an oxalate based deposit offers a much greater pre-lubrication effect with an oil having at least one fatty ester and/or calcium carbonate in a proportion of 5% or more, than with an oil that does not contain these components. The results clearly show the synergy of the oxalate based deposit with each of these components.

EXAMPLE 6

The purpose of this example is to illustrate that galvanized sheets treated according to the invention (application of the solution according to the invention by the roll-coating technique) then coated with a thin film of QUAKER 6130 oil have good properties for drawing as well as temporary corrosion [protection].

TABLE IV

Results of Behavior under Controlled Moisture/Heat Conditions and to Drawing

| METHODS | GSM (g/m$^2$ ± 0.02) | Behavior under controlled moisture/heat conditions; number of cycles before appearance of 10% white rust | Drawing |
|---|---|---|---|
| USICAR ™ reference | — | 20 cycles | Poor |
| USICAR ™ treated with $H_2C_2O_4$ at 0.1 M | 0.2 | Poor: 2 cycles | Excellent |
| USICAR ™ treated with $H_2C_2O_4$ at 0.05 M | 0.2 | Poor: 2 cycles | Excellent |
| USICAR ™ treated with 0.05 M $H_2C_2O_4$ + $10^{-[illegible]}$ M $CuCl_2$ Not rinsed | 0.23 | Good: 20 cycles | Excellent |
| USICAR ™ treated with 0.05 M $H_2C_2O_4$ + $10^{-[illegible]}$ M $CuCl_2$ Rinsed | 0.21 | Good: 18 cycles | Excellent |

TABLE IV-continued

Results of Behavior under Controlled Moisture/Heat Conditions and to Drawing

| METHODS | GSM ($g/m^2$ ± 0.02) | Behavior under controlled moisture/heat conditions; number of cycles before appearance of 10% white rust | Drawing |
|---|---|---|---|
| USICAR ™ treated with 0.05 M $H_2C_2O_4$ + $10^{-[illegible]}$ M $CuCl_2$ Not rinsed | 0.16 | Good: 24 cycles | Excellent |
| USICAR ™ treated with 0.05 M $H_2C_2O_4$ + $10^{-[illegible]}$ M $CuCl_2$ Rinsed | 0.18 | Good: 17 cycles | Excellent |
| USICAR ™ treated with 0.1 M $H_2C_2O_4$ + $10^{-[illegible]}$ M $CuCl_2$ Not rinsed | 0.21 | Good: 20 cycles | Excellent |
| USICAR ™ treated with 0.1 M $H_2C_2O_4$ + $10^{-[illegible]}$ M $CuCl_2$ Rinsed | 0.19 | Good: 18 cycles | Excellent |
| USICAR ™ treated with 0.1 M $H_2C_2O_4$ + $10^{-[illegible]}$ M $CuCl_2$ Not rinsed | 0.21 | Good: 20 cycles | Excellent |
| USICAR ™ treated with 0.1 M $H_2C_2O_4$ + $10^{-[illegible]}$ M $CuCl_2$ Rinsed | 0.20 | Good: 16 cycles | Excellent |

(Note: In this table, the unit mole/L is indicated by M.)

These results show that galvanized sheets (USICAR™) treated with oxalic acid alone and in weak concentrations (0.1 mole/L and 0.05 mole/L), and with a GSM of 0.2 $g/m^2$, have good drawing properties, but poor properties with respect to moisture and heat. The poor properties with respect to moisture and heat are probably related to the fact that the oxalation reaction used does not lead just to the formation of a $ZnC_2O_4$ type complex, but to the deposit of a mixed layer composed, in addition to said complex, of oxalic acid that has not reacted and/or of another complex of the $Zn(HC_2O_4)_2$ type, which also has acid functions. In the presence of oil, the free acid functions of the layer would react with the sulfonate functions of the oil (corrosion inhibitor compounds) by an acidobasic reaction. Because of this, the corrosion inhibiting properties of the oil would be depleted and it would no longer be able to provide its corrosion protection function.

Moreover, the addition of very small quantities of an activating agent like $Cu^{2+}$ to an oxalation bath in weak concentration ($10^{-3}$ or $10^{-4}$ mole/L) makes it possible to produce deposits on the treated galvanized surface that are nearly free from a soluble phase. Indeed, the results clearly show that there is no significant difference in GSM between rinsed and unrinsed samples.

In addition, from solutions according to the invention, that is, those for which the oxalic acid concentration varies from 0.05 mole/L to 0.1 mole/L and the $CuCl_2$ concentration varies from $10^{-3}$ to $10^{-4}$ mole/L, the GSM's of the zinc oxalate layers deposited on the treated galvanized surface are close to the target GSM (0.2 $g/m^2$), and lead to good properties with respect to heat and moisture, as well as excellent drawing properties.

What is claimed is:

1. A method for forming a zinc oxalate layer on the surface of a metal strip or sheet coated with a layer of zinc or zinc alloy, with the exception of zinc-iron alloys, comprising applying an aqueous oxalation solution to the surface of said metal strip or sheet, wherein said aqueous oxalation solution consists of oxalic acid in a concentration between $5\times10^{-3}$ and 0.1 mole/L, at least one compound and/or one ion of a zinc oxidizing metal in a concentration of between $10^{-6}$ and $10^{-2}$ mole/L, water, impurities and optionally a wetting agent.

2. The method according to claim 1, wherein said concentration of oxalic acid is between $5\times10^{-3}$ and $5\times10^{-2}$ mole/L.

3. The method according to claim 1, wherein the concentration of compounds and/or ion of a zinc oxidizing metal in said solution is between $10^{-6}$ and $10^{31\ 3}$ mole/L.

4. The method according to claim 1, wherein said at least one ion is chosen from the group consisting of $Ni^{2+}$, $Co^{2+}$, $Cu^{2+}$, $Fe^{2+}$, $Fe^{3+}$, $Mo^{3+}$, $Sn^{2+}$, and $Sn^{4+}$.

5. The method according to claim 1, wherein said aqueous oxalation solution is applied to said surface of a metal strip or sheet coated with a layer of zinc or zinc alloy without electrical polarization of said metal strip or sheet.

6. The method according to claim 1, wherein the GSM of said zinc oxalate layer is between 0.05 and 3 $g/m^2$.

7. A method of lubricating and temporarily protecting a metal strip or sheet coated with a layer of zinc or zinc alloy, with the exception of zinc-iron alloys, comprising forming a zinc oxalate layer on the surface of said metal strip or sheet coated with a layer of zinc or zinc alloy according to claim 1, followed by applying a layer of oil.

8. The method according to claim 7, wherein said oil has at least one fatty ester and/or calcium carbonate in a proportion of 5% or more.

9. A method of drawing a metal strip or sheet coated with a layer of zinc or zinc alloy, with the exception of zinc-iron alloys, comprising, prior to drawing, lubricating and temporarily protecting said metal strip or sheet coated with a layer of zinc or zinc alloy, with the exception of zinc-iron alloys, according to claim 7.

10. The method according to claim 1, wherein said aqueous oxalation solution is applied to the surface of said metal strip or sheet by immersion, spraying or roll coating followed by drying.

11. The method according to claim 10, further comprising rinsing between the application of said aqueous oxalation solution and the drying.

12. The method according to claim 1, wherein said aqueous oxalation solution is applied to the surface of said metal strip or sheet by roll coating followed by drying, without rinsing between the application of said aqueous oxalation solution and the drying.

13. The method according to claim 1, wherein said oxalate layer has at least 99% zinc oxalate.

14. A method for forming a zinc oxalate layer on the surface of a metal strip or sheet coated with a layer of zinc or zinc alloy, with the exception of zinc-iron alloys, comprising applying an aqueous oxalation solution to the surface of said metal strip or sheet, wherein said aqueous oxalation solution consists essentially of oxalic acid in a concentration between $5\times10^{-3}$ and 0.1 mole/L, at least one compound and/or one ion of a zinc oxidizing metal in a concentration of between $10^{-6}$ and $10^{-2}$ mole/L, water, and optionally a wetting agent.

* * * * *